US008863662B2

(12) United States Patent
Wolf et al.

(10) Patent No.: US 8,863,662 B2
(45) Date of Patent: Oct. 21, 2014

(54) SHEET GUIDING DEVICE AND SHEET BRAKE, DIECUTTER AND PRINTING PRESS HAVING THE DEVICE

(71) Applicant: Heidelberger Druckmaschinen AG, Heidelberg (DE)

(72) Inventors: Burkhard Wolf, Dossenheim (DE); Andreas Müller, Heidelberg (DE); Simon Klingler, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/951,699

(22) Filed: Jul. 26, 2013

(65) Prior Publication Data

US 2014/0026772 A1 Jan. 30, 2014

(30) Foreign Application Priority Data

Jul. 26, 2012 (DE) ..... 10 2012 014 807

(51) Int. Cl.
*B65H 39/02* (2006.01)
*B41F 21/00* (2006.01)

(52) U.S. Cl.
CPC ..... *B41F 21/00* (2013.01)
USPC ..... 101/419; 101/416.1

(58) Field of Classification Search
CPC ..... B41F 21/00
USPC ..... 101/419
See application file for complete search history.

(56) References Cited

U.S. PATENT DOCUMENTS

| | | | | |
|---|---|---|---|---|
| 3,659,839 | A | 5/1972 | Baucke | |
| 4,099,463 | A * | 7/1978 | Zimmermann et al. | 101/230 |
| 4,555,013 | A * | 11/1985 | Franklin | 198/689.1 |
| 6,523,572 | B1 * | 2/2003 | Levin et al. | 138/37 |
| 6,612,569 | B2 * | 9/2003 | Schaum | 271/241 |
| 6,640,707 | B2 | 11/2003 | Frankenberger et al. | |
| 6,648,326 | B2 * | 11/2003 | Hieb | 271/183 |
| 7,384,035 | B2 | 6/2008 | Detloff | |
| 2002/0005612 | A1 * | 1/2002 | Stephan | 271/264 |
| 2010/0052250 | A1 * | 3/2010 | Iijima et al. | 271/265.01 |

FOREIGN PATENT DOCUMENTS

| | | |
|---|---|---|
| DE | 1917616 | 10/1970 |
| DE | 10141415 A1 | 3/2002 |

OTHER PUBLICATIONS

German Patent and Trademark Office Search Report Dated Aug. 23, 2012.

* cited by examiner

*Primary Examiner* — Anthony Nguyen
(74) *Attorney, Agent, or Firm* — Laurence A. Greenberg; Werner H. Sterner; Ralph E. Locher

(57) ABSTRACT

A device for guiding sheets in a sheet-fed rotary printing press or diecutter includes a sheet-guiding plate with openings and a cover plate disposed parallel thereto and being displaceable by an applied operating pressure. A flexible intermediate layer disposed between the sheet-guiding plate and the cover plate has passages with a cross section which is variable by the operating pressure. A sheet brake, a diecutter and a printing press having the sheet guiding device are also provided.

15 Claims, 3 Drawing Sheets

SHEET GUIDING DEVICE AND SHEET BRAKE, DIECUTTER AND PRINTING PRESS HAVING THE DEVICE

CROSS-REFERENCE TO RELATED APPLICATION

This application claims the priority, under 35 U.S.C. §119, of German Patent Application DE 10 2012 014 807.0, filed Jul. 26, 2012; the prior application is herewith incorporated by reference in its entirety.

BACKGROUND OF THE INVENTION

Field of the Invention

The invention relates to a device for guiding sheets in a sheet-processing machine such as a printing press or diecutting machine. The invention also relates to a sheet brake, a diecutter and a printing press having the sheet guiding device.

U.S. Pat. No. 7,384,035 B2 discloses a sheet-guiding plate that has suction or blower nozzles to generate throttled suction air or throttled blown air. Each of the suction or blower nozzles includes a channel with multiple vortex chambers for generating throttled blown or suction air.

German Patent Application DE 1 917 616, corresponding to U.S. Pat. No. 3,659,839, discloses a sheet-guiding plate in the region of a sheet brake. Suction air is applicable to the sheet-guiding plate. Suction openings are provided to act on the sheet to be braked. The suction openings are closable in accordance with the operating cycle of the machine by using a control belt. An additional slide member is provided to allow a modification of the cross section of the suction opening.

BRIEF SUMMARY OF THE INVENTION

It is accordingly an object of the invention to provide a sheet guiding device and a sheet brake, a diecutter and a printing press having the sheet guiding device, which overcome the hereinafore-mentioned disadvantages of the heretofore-known devices, brakes, diecutters and printing presses of this general type and which provide an alternative configuration for modification of a nozzle cross section in a sheet-guiding plate.

With the foregoing and other objects in view there is provided, in accordance with the invention, a device for guiding sheets in a sheet-processing machine. The device comprises a guide plate having blower or suction openings formed therein, a cover plate disposed parallel to the guide plate and having passages formed therein, a flexible intermediate layer disposed between the guide plate and the cover plate and having other passages formed therein, and throttle nozzles formed by the blower or suction openings in the guide plate, the other passages in the intermediate layer and the passages in the cover plate.

A particular advantage of the invention is that a nozzle cross section is adjustable. This feature permits adaptation of a suction or blower performance to different operating parameters such as the characteristics of the material to be processed or the machine speed.

In particular, the nozzle cross section may be enlarged for cleaning purposes. A particular advantage of the invention over the prior art is that no actuators are required to control the nozzle cross section because the nozzle cross section is automatically controlled in a particularly advantageous way through the operating pressure which is provided.

In accordance with an advantageous alternative, an additional control pressure is provided to control a nozzle cross section independently of the operating pressure. In this way, both throttled suction air and throttled blown air may be provided depending on the operating pressure.

Other features which are considered as characteristic for the invention are set forth in the appended claims.

Although the invention is illustrated and described herein as embodied in a sheet guiding device and a sheet brake, a diecutter and a printing press having the sheet guiding device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
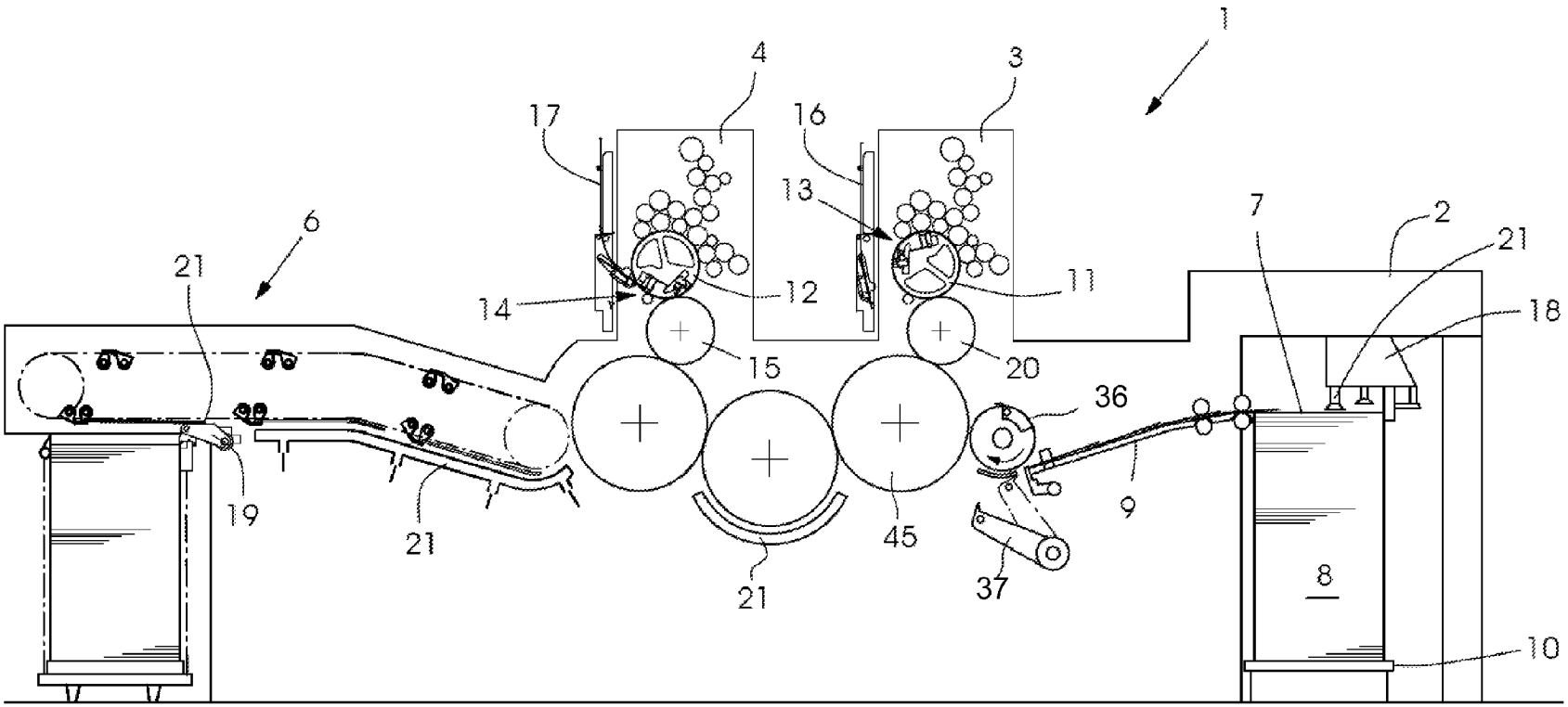
FIG. 1 is a diagrammatic, longitudinal-sectional view of a sheet-fed rotary printing press.

Referring now to the figures of the drawings in detail and first, particularly, to FIG. 1 thereof, there is seen a machine, for example a printing press 1 or a diecutter, which processes sheets 7 and includes a feeder 2. The printing press 1 shown in FIG. 1 further includes at least one printing unit 3, 4 and a delivery 6. The sheets 7 are taken from a sheet stack 8 and are fed to the printing units 3, 4 either individually or in shingled formation over a feed table 9. Alignment of the sheets 7 before the printing unit 3 is carried out on a feed drum 36. Transfer of the sheet 7 from the feed table 9 to the feed cylinder 36 is carried out by an oscillating pre-gripper 37. Each printing unit 3, 4 includes a plate cylinder 11, 12, a blanket cylinder 20, 15 and an impression cylinder 45 with a transfer drum disposed therebetween, as known in the art. Each plate cylinder 11, 12 includes a device 13, 14 for mounting flexible printing plates. In addition, each plate cylinder 11, 12 is assigned a device 16, 17 for a semiautomatic or fully automated printing plate exchange.

The sheet stack 8 rests on a main stack plate 10 that is liftable in a controlled manner. The sheets 7 are removed from the top of the sheet stack 8 by using a suction head 18 which, among other components, includes a number of lifting and dragging suction elements to separate the sheets 7. In addition, blower devices are provided to aerate the upper sheet layers and push buttons are provided to lift the sheet stack as needed. A number of lateral and rear stops are provided in order to align the stack 8 of sheets, in particular the uppermost sheets 7 of the stack 8 of sheets.

Sheet-guiding elements 21 in the form of sheet-guiding plates are provided to guide the sheets 7 in the region of the printing units 3, 4 or in the delivery 6, in particular at a sheet brake 19 provided for forming the stack.

Figure 2:
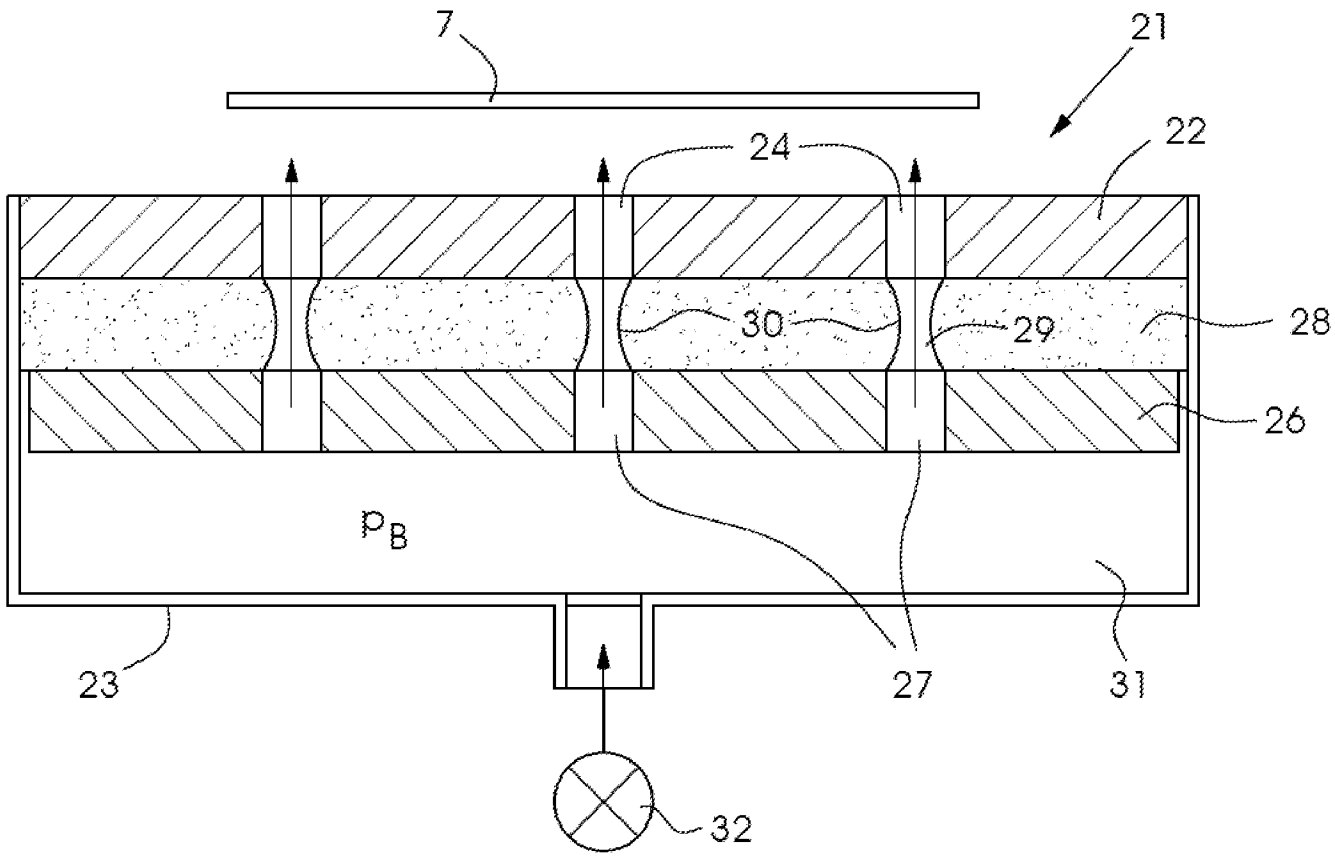
FIG. 2 is an enlarged, cross-sectional view of a sheet-guiding plate with nozzles having variable cross-sections.

FIG. 2 illustrates a sheet-guiding element 21 of the invention including a housing 23 with a sheet-guiding plate 22 that has blower openings 24 formed on the side facing the sheets 7. The sheet-guiding element 21 further includes a cover plate 26 disposed to be parallel to and spaced apart from the sheet-guiding plate 22 and to be displaceable in parallel. The cover plate 26 acts as a control plate. Passages 27 formed in the control plate 26 are aligned with the blower openings 24 of the sheet-guiding element 21. A flexible, slightly deformable intermediate layer 28 is provided at a distance between the sheet-guiding plate 22 and the control plate 26. The intermediate layer 28 has other passages 29 aligned with the blower openings 24 and passages 27.

The passages 27 are commonly connected to a pressure chamber 31, which is in turn connected to a pressure generator 32.

The control plate 26 is displaced to a greater or lesser extent to increase or decrease the volume of the pressure chamber 31 in a corresponding way, in dependence on an amount of operating pressure $p_B$ (pressure in the pressure chamber 31) provided by the pressure generator 32. The flexible intermediate layer 28 is compressed at an increased operating pressure $p_B$, thus reducing the cross section of a throttle or throttle nozzle 30. This measure results in a throttling of blown air by increasing the operating pressure $p_B$.

When the operating pressure $p_B$ is reduced, the flexible intermediate layer 28 displaces the control plate 26 in such a way that the volume of the pressure chamber 31 is reduced and the throttle cross section is increased. The blown air emerging from the throttles 30 may thus emerge from the nozzles 30 in a largely unimpeded way, allowing the throttles 30 to be cleaned at a low operating pressure $p_B$.

Figure 3:
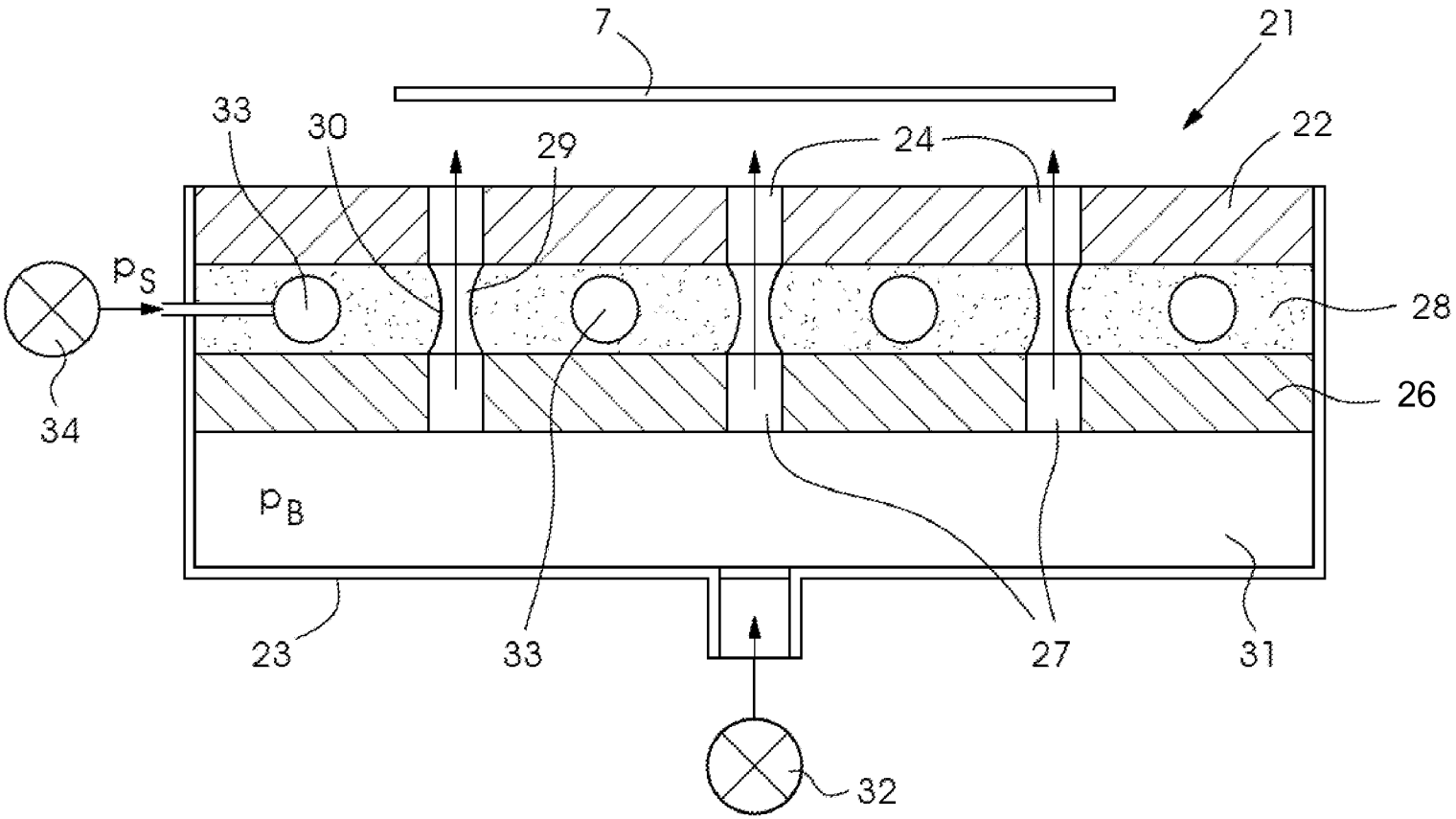
FIG. 3 is a cross-sectional view of a sheet-guiding plate with nozzles having a cross-section that can be varied by an additional control pressure.

An exemplary embodiment shown in FIG. 3 additionally includes control channels 33 in the flexible intermediate layer 28. The control channels 33 are connected to each other and to a pressure generator 34. The flexible intermediate layer 28 is limited in the direction of the pressure chambers 31 by a cover plate 26 firmly connected to the housing 23. The pressure generator 34 supplies a control pressure $p_s$ to the control channels 33, causing the intermediate layer 28 to be deformed and thus to modify the cross section of the throttles 30.

This measure allows the throttle cross section to be continuously adjusted independently of the operating pressure $p_B$.

In order to generate throttled suction air, for example at the sheet brake 19, in a device in accordance with FIG. 3, a provision is made for the operating pressure $p_B$ to be less than 1 bar ($p_B$<1 bar). Due to this measure, the throttle cross section of a suction nozzle can be adjusted by the control pressure $p_S$.

The invention claimed is:

1. A device for guiding sheets in a sheet-processing machine, the device comprising:

a guide plate having blower or suction openings formed therein;

a cover plate disposed parallel to said guide plate and having passages formed therein;

a flexible intermediate layer disposed between said guide plate and said cover plate and having other passages formed therein; and throttle nozzles formed by said blower or suction openings in said guide plate, said other passages in said intermediate layer and said passages in said cover plate.

2. The device according to claim 1, which further comprises a pressure chamber configured to supply an operating pressure to said passages in said cover plate.

3. The device according to claim 1, wherein said cover plate is configured to be movable.

4. The device according to claim 2, wherein said cover plate is configured to be movable by said operating pressure.

5. The device according to claim 1, wherein said intermediate layer is constructed to be compressible.

6. The device according to claim 4, wherein said intermediate layer is constructed to be compressible by said cover plate.

7. The device according to claim 1, wherein said cover layer is immovable and said intermediate layer has control channels formed therein.

8. The device according to claim 2, wherein said cover layer is immovable and said intermediate layer has control channels formed therein.

9. The device according to claim 5, wherein said cover layer is immovable and said intermediate layer has control channels formed therein.

10. The device according to claim 1, wherein said cover layer is immovable, and said intermediate layer has control channels formed therein and is configured to modify a cross section of said throttle nozzles.

11. The device according to claim 7, wherein said control channels are configured to receive a control pressure.

12. The device according to claim 10, wherein said control channels are configured to receive a control pressure.

13. A sheet brake, comprising a device according to claim 1.

14. A diecutter, comprising a device according to claim 1.

15. A sheet-fed rotary printing press, comprising a device according to claim 1.

* * * * *